US012800233B2

(12) United States Patent
Tissot et al.

(10) Patent No.: US 12,800,233 B2
(45) Date of Patent: Nov. 17, 2026

(54) PLATE HEAT EXCHANGER HAVING A LARGE NUMBER OF HEAT EXCHANGE COMPARTMENTS

(71) Applicant: Valeo Systemes Thermiques, Le Mesnil-Saint-Denis (FR)

(72) Inventors: Julien Tissot, Le Mesnil-Saint-Denis (FR); Kamel Azzouz, Le Mesnil-Saint-Denis (FR); Julio Guerra, Le Mesnil-Saint-Denis (FR); Moussa Nacer Bey, Le Mesnil-Saint-Denis (FR)

(73) Assignee: Valeo Systemes Thermiques, Le Mesnil-Saint-Denis (FR)

( * ) Notice: Subject to any disclaimer, the term of this patent is extended or adjusted under 35 U.S.C. 154(b) by 159 days.

(21) Appl. No.: 18/573,007

(22) PCT Filed: Jun. 14, 2022

(86) PCT No.: PCT/EP2022/066223
§ 371 (c)(1),
(2) Date: Dec. 21, 2023

(87) PCT Pub. No.: WO2022/268586
PCT Pub. Date: Dec. 29, 2022

(65) Prior Publication Data

US 2024/0295365 A1 Sep. 5, 2024

(30) Foreign Application Priority Data

Jun. 22, 2021 (FR) ..... 2106645

(51) Int. Cl.
*F28D 9/00* (2006.01)
*F28F 3/08* (2006.01)

(52) U.S. Cl.
CPC ..... *F28D 9/0075* (2013.01); *F28D 9/0093* (2013.01); *F28F 3/086* (2013.01)

(58) Field of Classification Search
CPC ..... F28D 9/0075; F28D 9/0093; F28F 3/086
See application file for complete search history.

(56) References Cited

U.S. PATENT DOCUMENTS 3,513,907 A 5/1970 Hughes
7,753,105 B2 7/2010 Acre
(Continued)

FOREIGN PATENT DOCUMENTS

CN 201772791 U 3/2011
CN 103370594 A 10/2013
(Continued)

OTHER PUBLICATIONS

Translation of KR20160147342 named Translation—KR20160147342 (Year: 2016).*
(Continued)

*Primary Examiner* — Paul Alvare
(74) *Attorney, Agent, or Firm* — Osha Bergman Watanabe & Burton LLP

(57) ABSTRACT

A plate heat exchanger that includes a first, second, and third heat-exchange compartment is disclosed. The heat-exchange compartments include circulation paths in which heat-transfer fluids circulate. The heat-exchange compartments are fluidly connected to allow the heat-transfer fluids to circulate between them. The first and second heat-exchange compartments are stacked. The first and third heat-exchange compartments are arranged side by side.

10 Claims, 8 Drawing Sheets

(56) References Cited

U.S. PATENT DOCUMENTS

Figure 1:
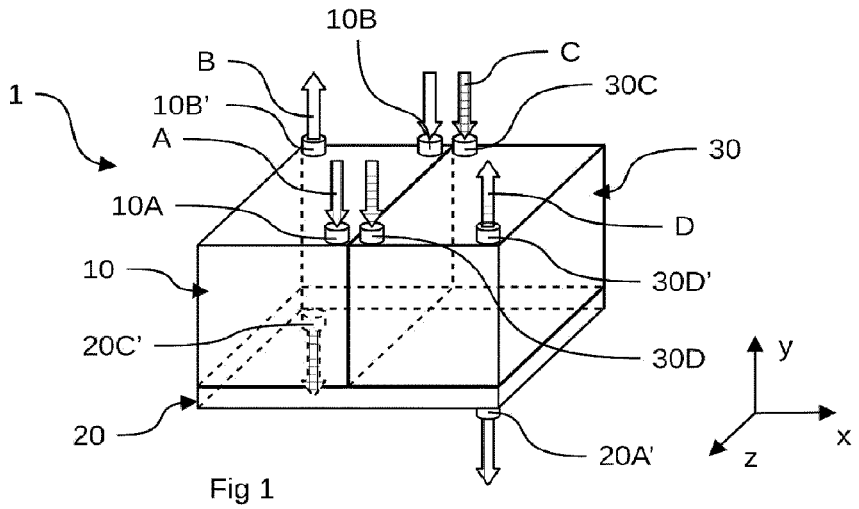

| | | | | |
|---|---|---|---|---|
| 2004/0159424 | A1* | 8/2004 | Reinke | F28F 13/08 165/140 |
| 2012/0060550 | A1* | 3/2012 | Mann | F25B 39/00 62/513 |
| 2012/0210746 | A1* | 8/2012 | Kadle | B60H 1/32284 165/166 |
| 2013/0061630 | A1* | 3/2013 | Schaefer | F28D 9/005 62/502 |
| 2015/0323231 | A1* | 11/2015 | Citti | F28D 9/005 62/516 |
| 2017/0030255 | A1* | 2/2017 | Tokozakura | F01P 11/08 |
| 2017/0097179 | A1* | 4/2017 | Martin | F25B 39/00 |
| 2018/0120033 | A1* | 5/2018 | Mougnier | F28D 9/005 |
| 2020/0031198 | A1* | 1/2020 | Chen | B60H 1/00278 |
| 2020/0173695 | A1* | 6/2020 | Dahlberg | F28D 9/0093 |

FOREIGN PATENT DOCUMENTS

| | | | | | |
|---|---|---|---|---|---|
| CN | 109416230 | A | | 3/2019 | |
| FR | 2846736 | A1 | | 5/2004 | |
| KR | 10-2016-0147342 | A | | 12/2016 | |
| KR | 20160147342 | A | * | 12/2016 | B60H 1/3227 |

OTHER PUBLICATIONS

International Search Report and Written Opinion in corresponding International Application No. PCT/EP2022/066223, dated Jul. 28, 2022 (12 pages).

Office Action in the corresponding Chinese Application No. 202280044276.2 dated Mar. 16, 2026 (8 pages).

* cited by examiner

PLATE HEAT EXCHANGER HAVING A LARGE NUMBER OF HEAT EXCHANGE COMPARTMENTS

The present invention relates to a plate heat exchanger having various fluid-exchange compartments. The present invention also relates to an installation comprising a refrigerant fluid circuit, at least one auxiliary circulation circuit for a heat-transfer fluid with such a plate heat exchanger.

In the automotive sector, it is common to have to modify a temperature of a component such as an electric motor, a battery, a heat and/or cold storage device or similar. To this end, the motor vehicle is equipped with an installation which comprises a refrigerant fluid circuit inside which a refrigerant fluid circulates and at least one auxiliary circulation circuit inside which a heat-transfer fluid circulates. The refrigerant fluid circuit generally comprises a compressor for compressing the refrigerant fluid, a first heat exchanger, generally called a condenser, for cooling the refrigerant fluid to constant pressure, an expansion device for allowing expansion of the refrigerant fluid, and a second heat exchanger, called a cooler, for example, a two-fluid heat exchanger, generally with plates, arranged jointly in the refrigerant fluid circuit and in the auxiliary circulation circuit. This two-fluid heat exchanger makes it possible in particular to exchange heat energy between the refrigerant fluid and the heat-transfer fluid circulating in the auxiliary circulation circuit. The auxiliary circulation circuit for its part generally comprises a pump and a heat exchanger capable of modifying a temperature of a component.

The two-fluid heat exchanger is an exchanger generally comprising stacked plates joined together to form tubes delimiting chambers for circulation of the refrigerant fluid or of the heat-transfer liquid. The plate comprises at least four orifices to allow a first inlet and a first outlet of the refrigerant fluid, and a second inlet and a second outlet of the heat-transfer liquid inside the circulation chambers situated on either side of the same plate.

It is also known, in order to improve the coefficient of performance of the refrigerant fluid circuit, to provide the latter with an internal heat exchanger configured to allow exchanges of heat energy between the high-pressure refrigerant fluid at the outlet of the condenser and the low-pressure refrigerant fluid at the outlet of the cooler.

The multiplication of these heat exchangers admittedly allows better efficiency; however, this also leads to problems of bulk and connection of the various heat exchangers within the motor vehicle.

One of the objects of the present invention is to overcome at least partially the drawbacks of the prior art and to propose a heat exchanger that is compact and capable of grouping together several functions in order to occupy the least possible space and facilitating the connection of the heat exchangers.

The present invention therefore relates to a plate heat exchanger comprising:

- a first heat-exchange compartment comprising a first circulation path in which a first heat-transfer fluid is intended to circulate, and a second circulation path in which a second heat-transfer fluid is intended to circulate, said first compartment comprising an outlet for the first heat-transfer fluid,
- a second heat-exchange compartment comprising a third circulation path in which the first heat-transfer fluid coming from the first heat-exchange compartment is intended to circulate, and a fourth circulation path in which a third heat-transfer fluid is intended to circulate, said second compartment comprising an inlet for the first heat-transfer fluid, and
- a third heat-exchange compartment comprising a fifth circulation path in which a fourth heat-transfer fluid is intended to circulate, and a sixth circulation path in which the third heat-transfer fluid is intended to circulate, said third compartment comprising an outlet for the third heat-transfer fluid, the outlet for the first heat-transfer fluid from the first heat-exchange compartment being connected to the inlet for the first heat-transfer fluid into the second heat-exchange compartment,
- the outlet for the third heat-transfer fluid from the third heat-exchange compartment being connected to the inlet for the third heat-transfer fluid into the second heat-exchange compartment,
- the first compartment and the second compartment being stacked so that the outlet for the first heat-transfer fluid from the first compartment is opposite and connected to the inlet for the first heat-transfer fluid into the second compartment and the third compartment being arranged side by side with the first compartment.

According to one aspect of the invention, the first and third heat-exchange compartments are arranged side by side and stacked on the same face of the second heat-exchange compartment, the outlet for the third heat-transfer fluid from the third heat-exchange compartment is opposite and connected to the inlet for the third heat-transfer fluid into the second heat-exchange compartment.

According to another aspect of the invention, the third compartment is arranged side by side with the superposition of the first and second compartments.

According to another aspect of the invention, the second and third compartments are made from two separate stacks of plates.

According to another aspect of the invention, the side-by-side parts of the second and third compartments are made from a single stack of plates comprising the third, fourth, fifth and sixth circulation paths.

According to another aspect of the invention, the first and third compartments are made from two separate stacks of plates.

According to another aspect of the invention, the side-by-side parts of the first and third compartments are made from a single stack of plates comprising the first, second, fifth and sixth circulation paths.

According to another aspect of the invention, the second heat-exchange compartment comprises a second inlet for the first refrigerant fluid.

According to another aspect of the invention, the second heat-exchange compartment comprises a second inlet for the third refrigerant fluid.

According to another aspect of the invention, the heat exchanger comprises a fourth heat-exchange compartment comprising:

- a seventh circulation path in which the fourth heat-transfer fluid is intended to circulate, and
- an eighth circulation path in which the third heat-transfer fluid is intended to circulate.

According to another aspect of the invention, the outlet for the third heat-transfer fluid from the fourth heat-exchange compartment and the outlet for the third heat-transfer fluid from the third heat-exchange compartment are connected to the inlet for the third heat-transfer fluid into the second heat-exchange compartment.

According to another aspect of the invention, the first heat-exchange compartment is a water condenser:

the first circulation path being intended to be traversed by the first heat-transfer fluid, said first heat-transfer fluid being a high-pressure refrigerant fluid circulating in a thermal management loop, the second circulation path being intended to be traversed by the second heat-transfer fluid, said second heat-transfer fluid being a heat-transfer fluid circulating in an auxiliary thermal management loop, the third heat-exchange compartment being a cooler:

the fifth circulation path being intended to be traversed by the fourth heat-transfer fluid, said fourth heat-transfer fluid being a heat-transfer fluid circulating in an auxiliary thermal management loop, the sixth circulation path being intended to be traversed by the third heat-transfer fluid, said third heat-transfer fluid being the low-pressure refrigerant fluid circulating in the thermal management loop, the second heat-exchange compartment being an internal heat exchanger:

the third circulation path being intended to be traversed by the high-pressure refrigerant fluid having traversed the first heat-exchange compartment, corresponding to the first heat-transfer fluid, the fourth circulation path being intended to be traversed by the low-pressure refrigerant fluid having traversed the third heat-exchange compartment, corresponding to the third heat-transfer fluid.

Figure 2:
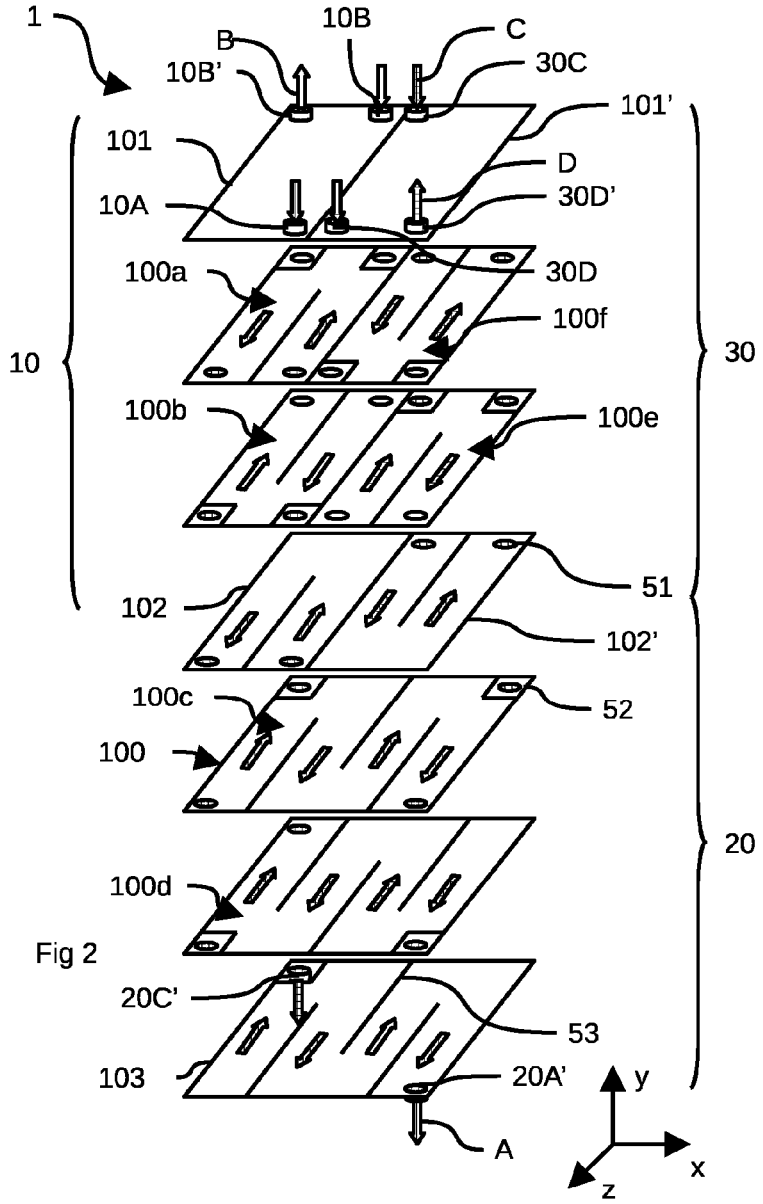
Figure 3:
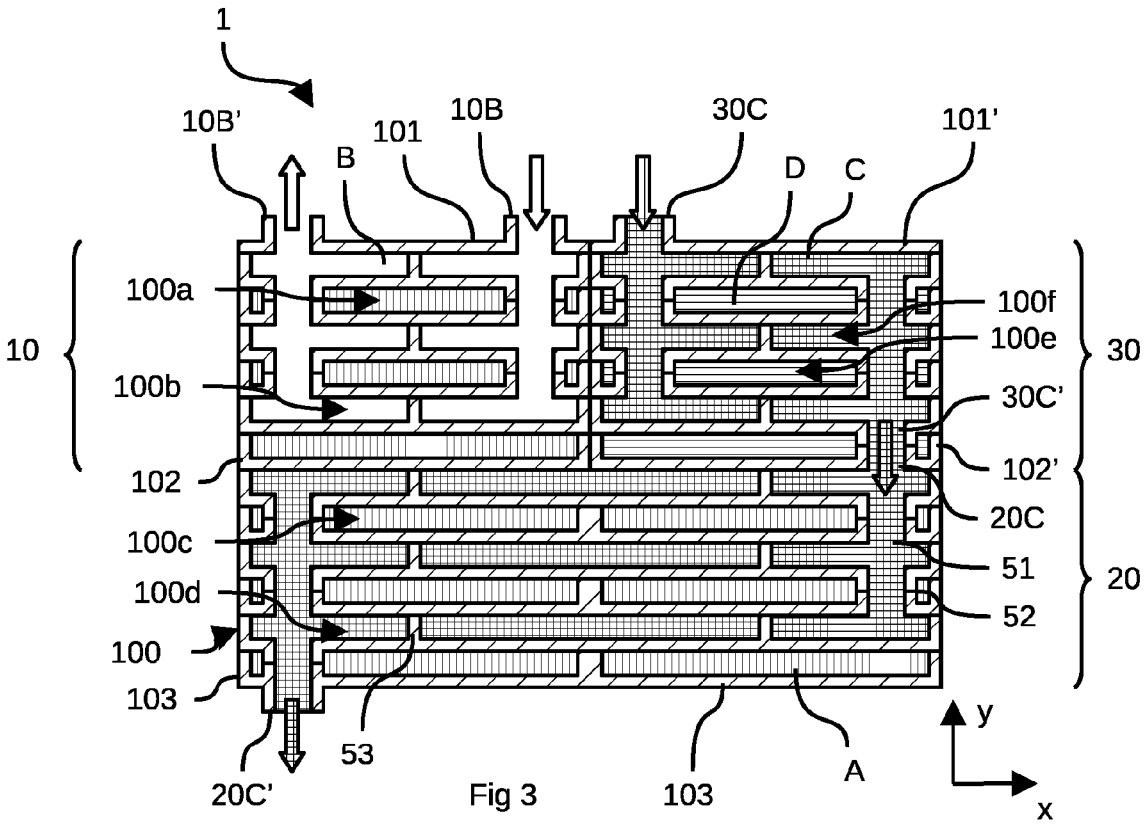
Figure 4:
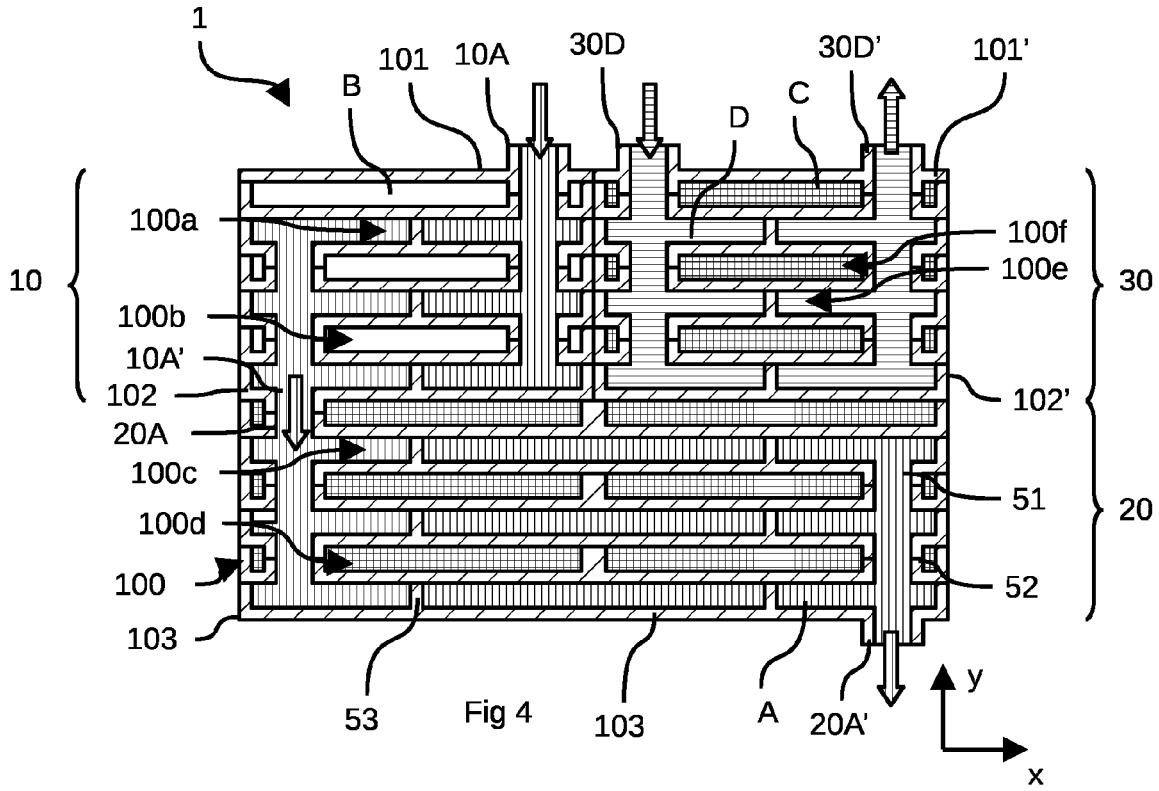
Figure 5:
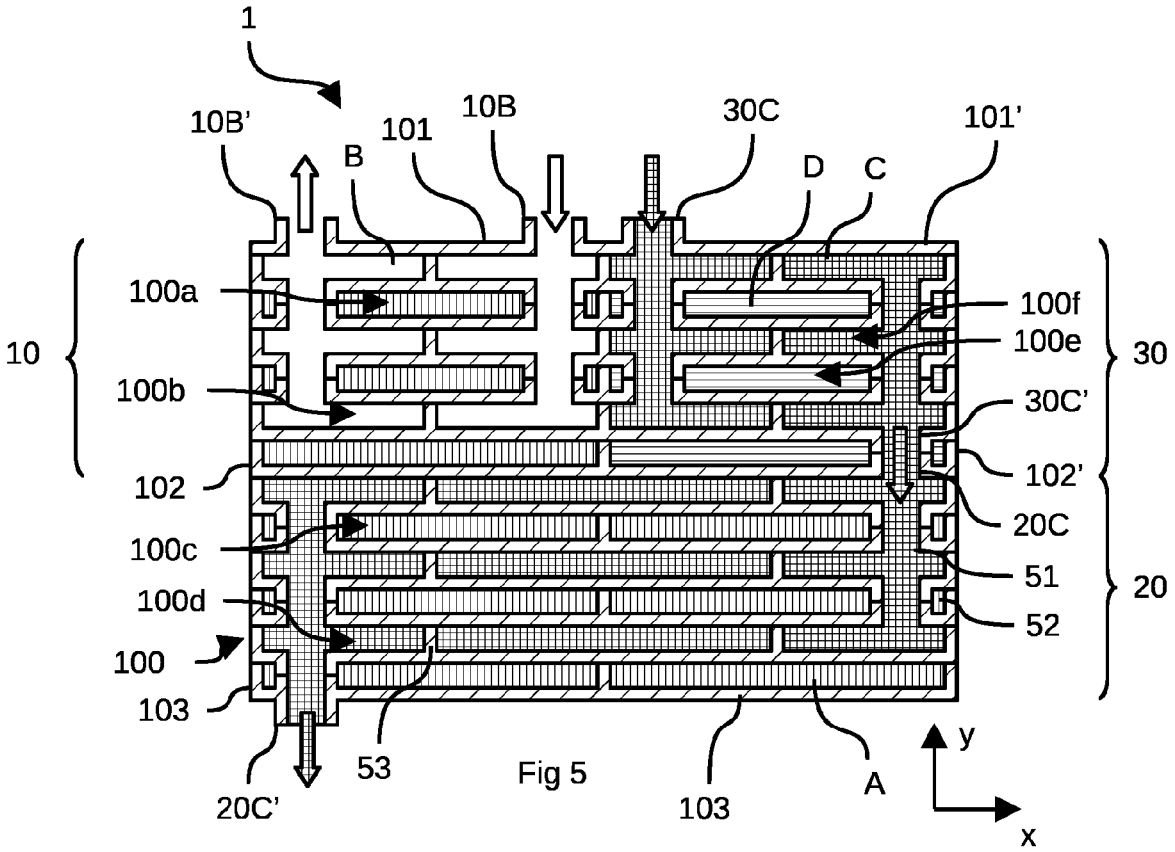
Figure 6:
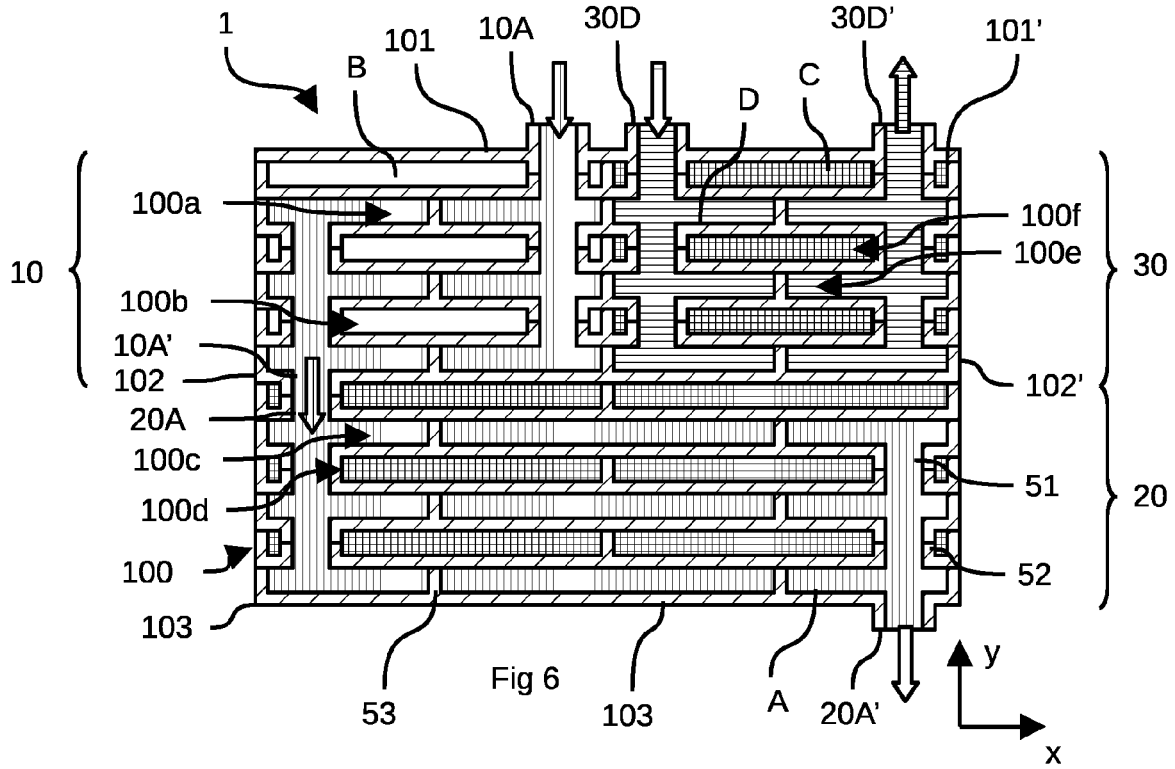
Figure 7:
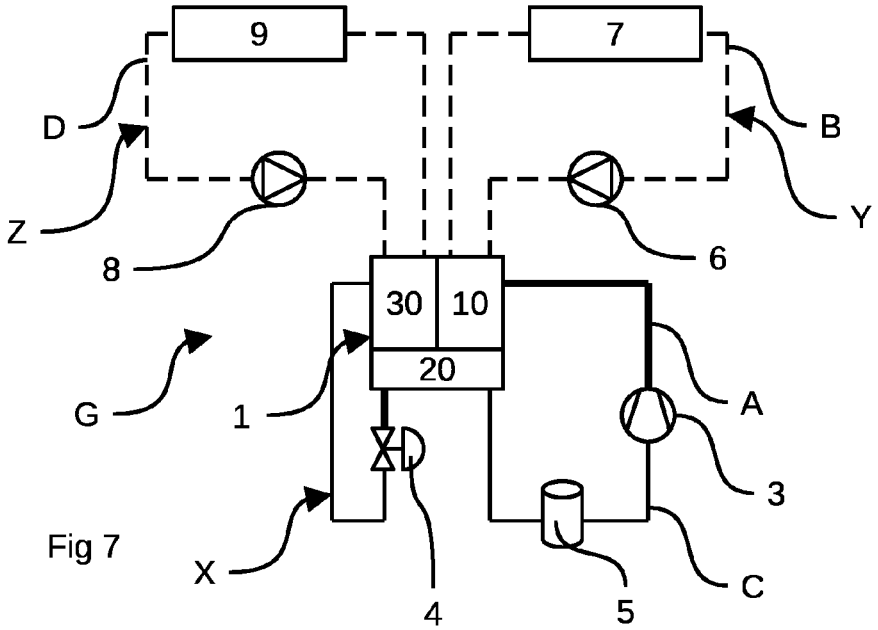
Figure 8:
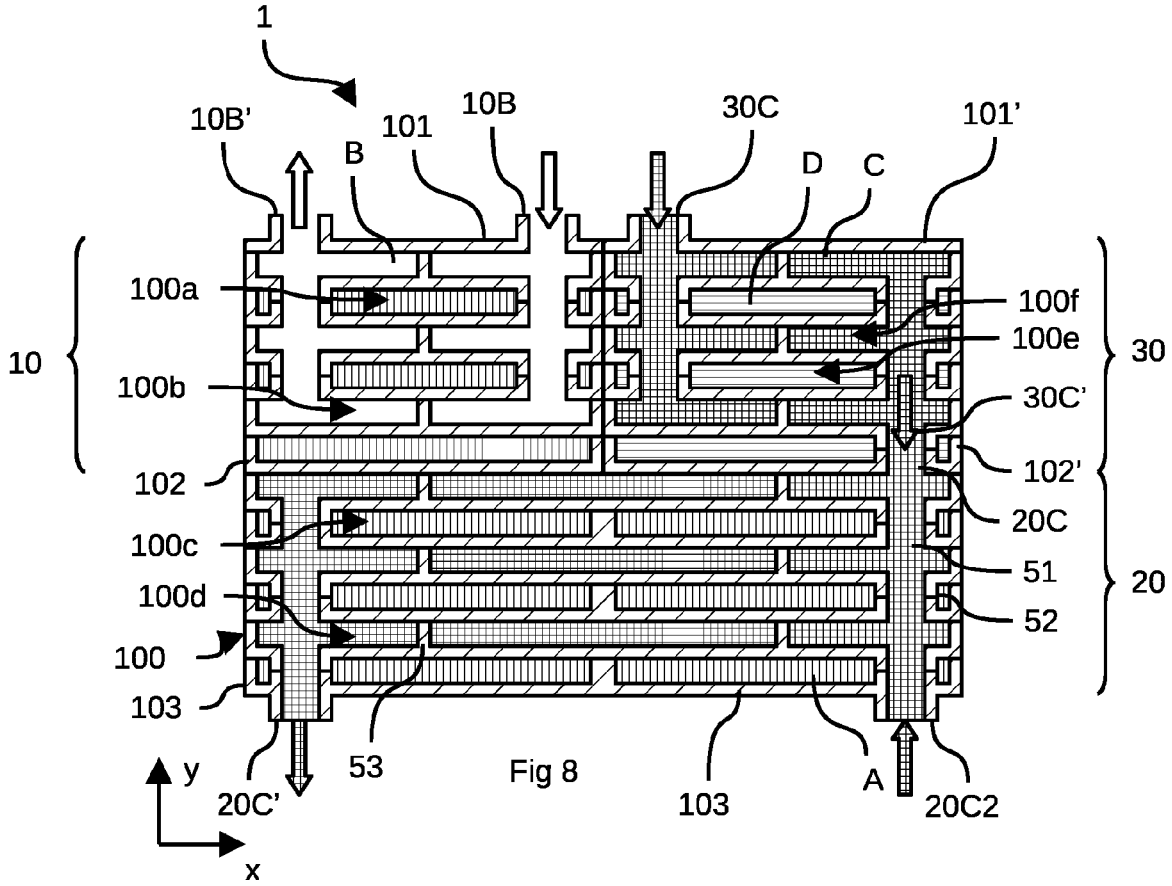
Figure 9:
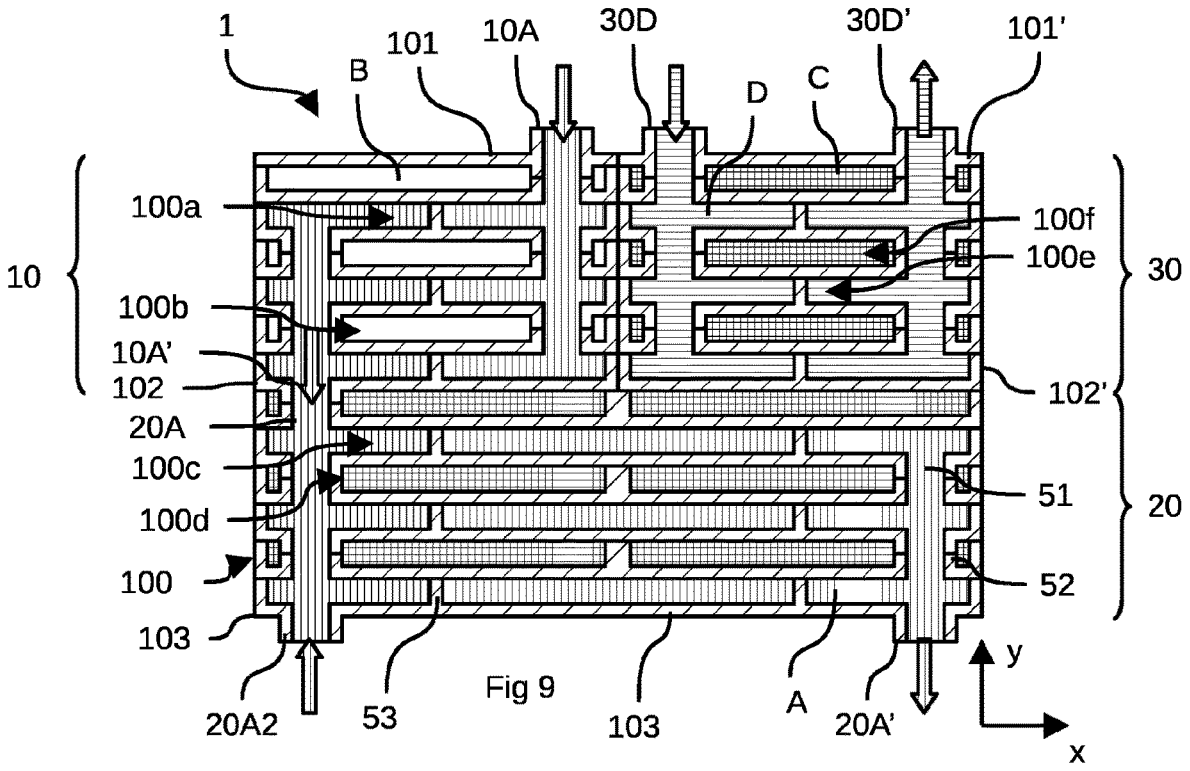
Figure 10:
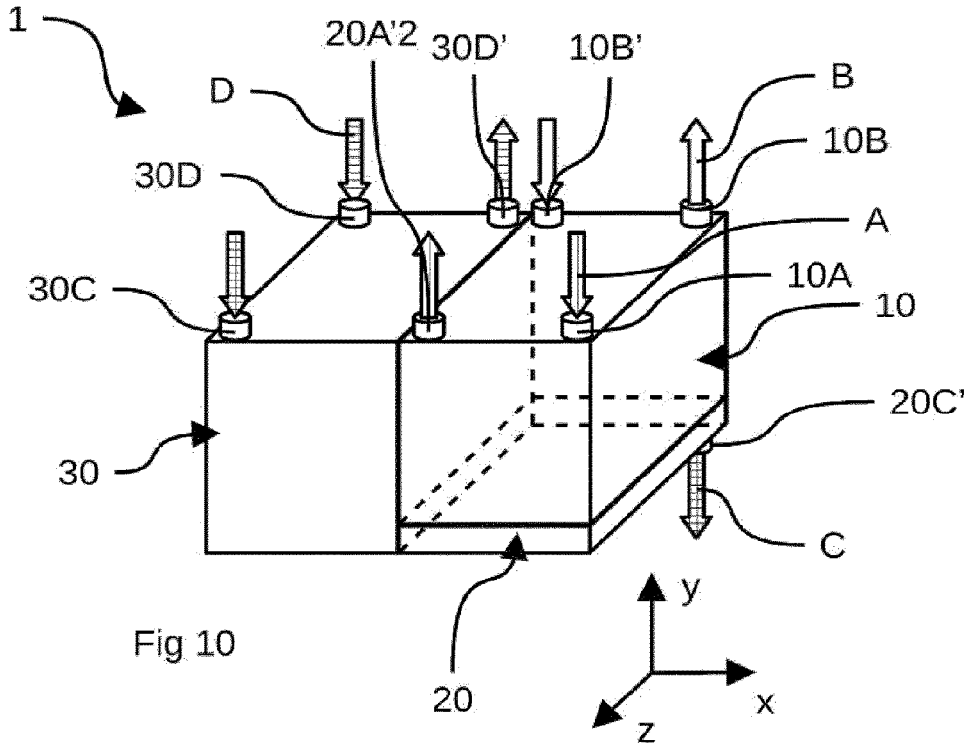
Figure 11:
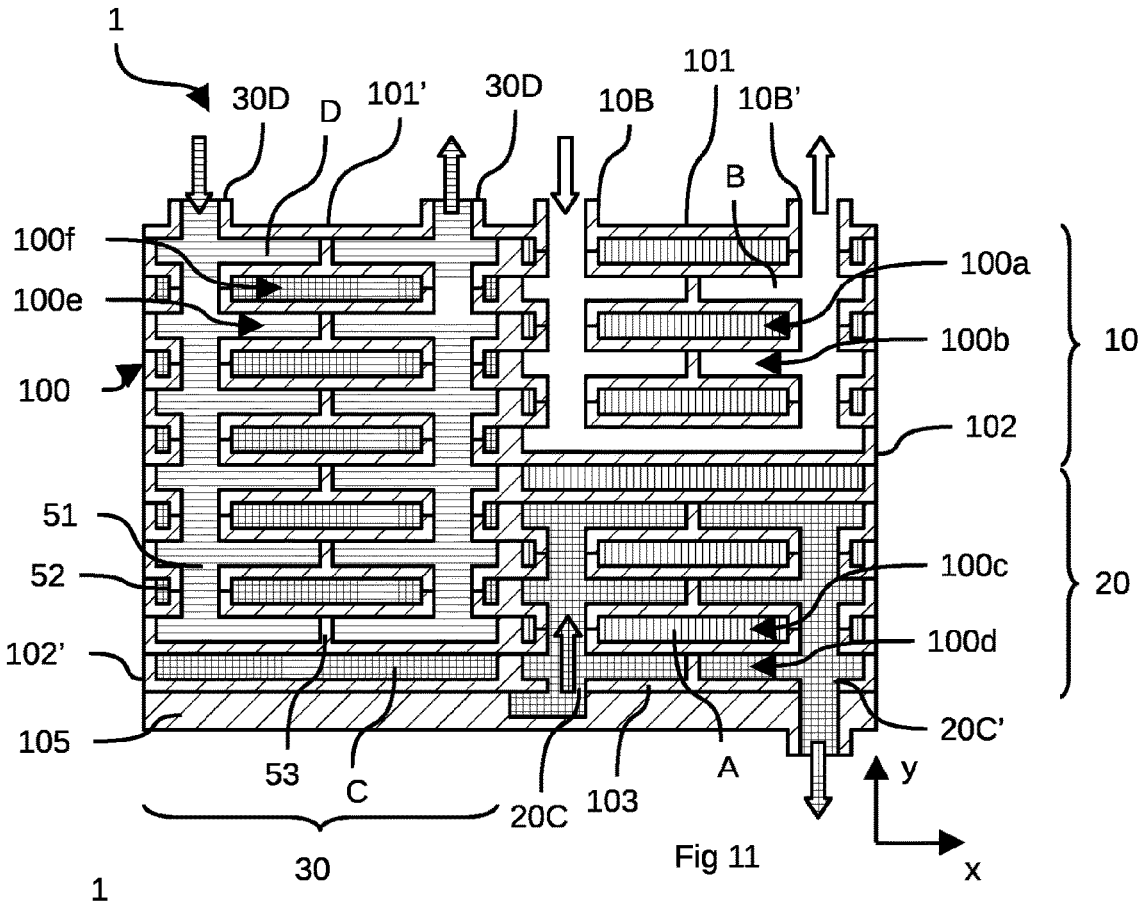
Figure 12:
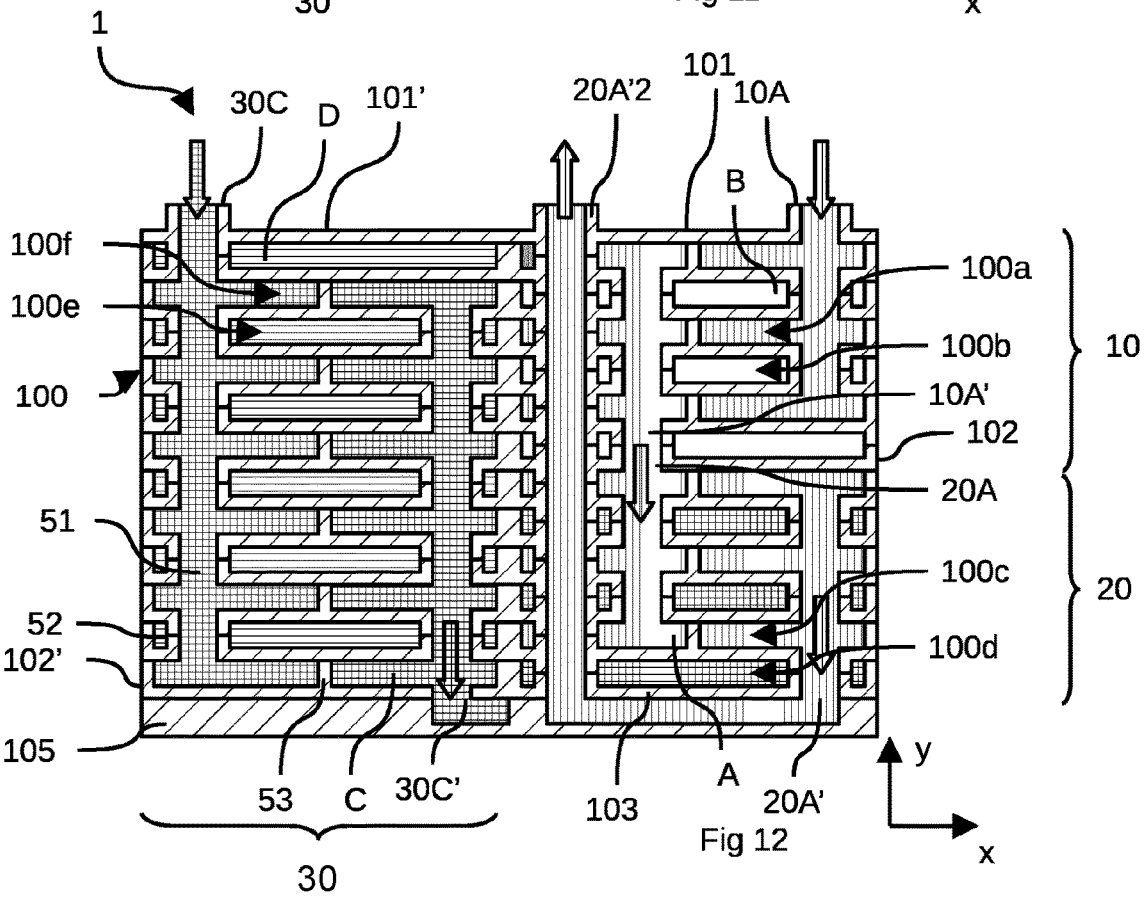
Figure 13:
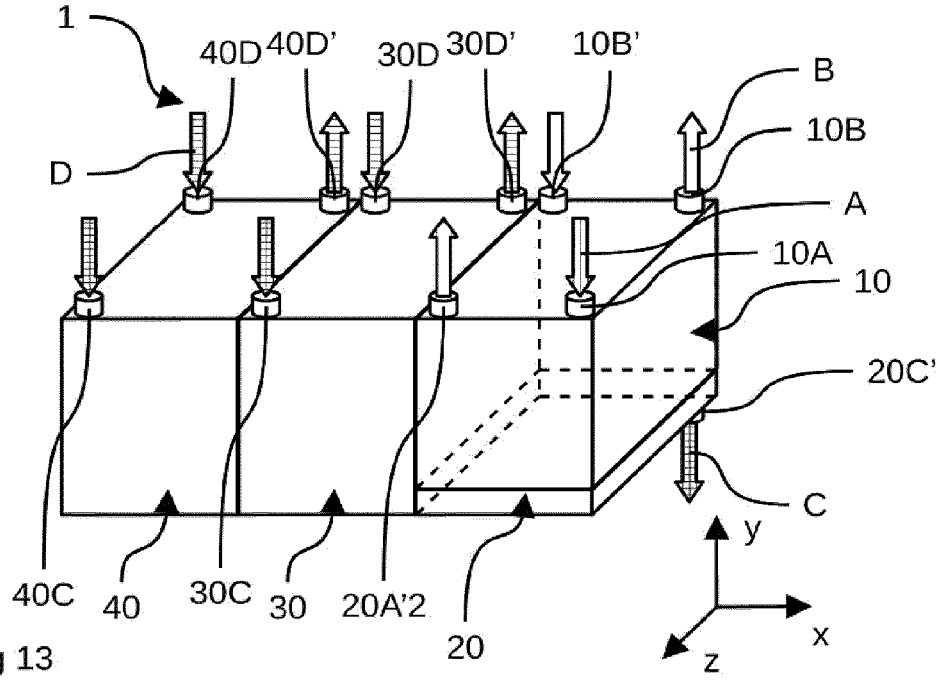
Figure 14:
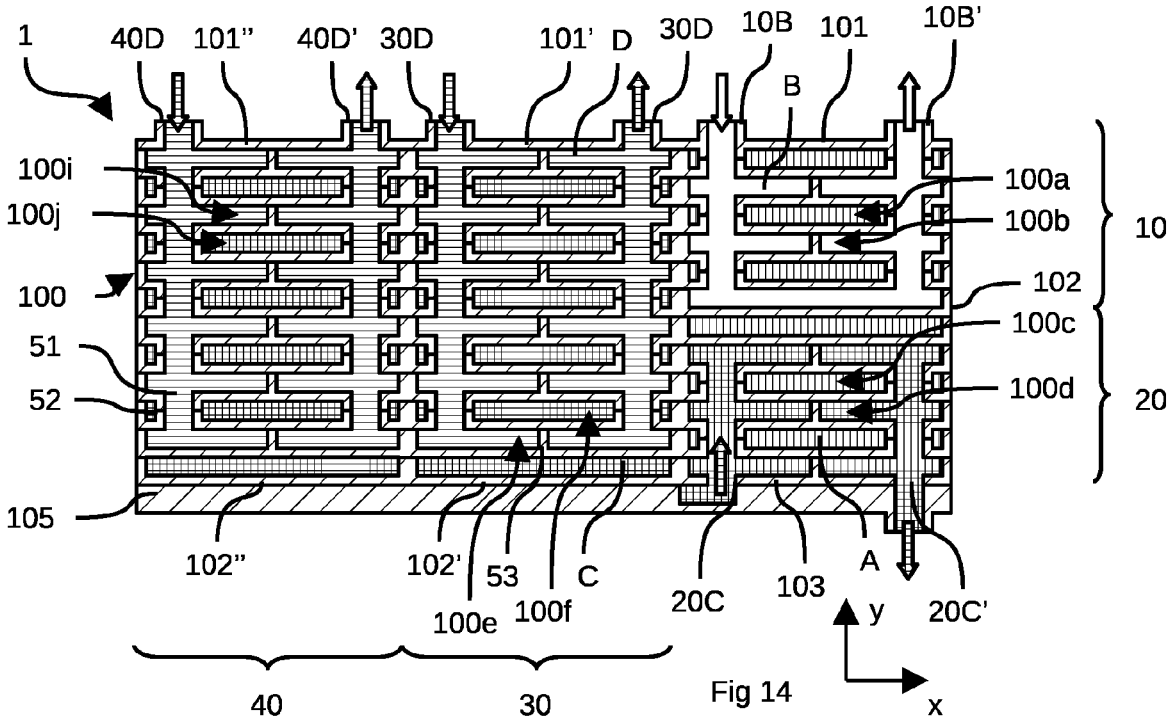
Figure 15:
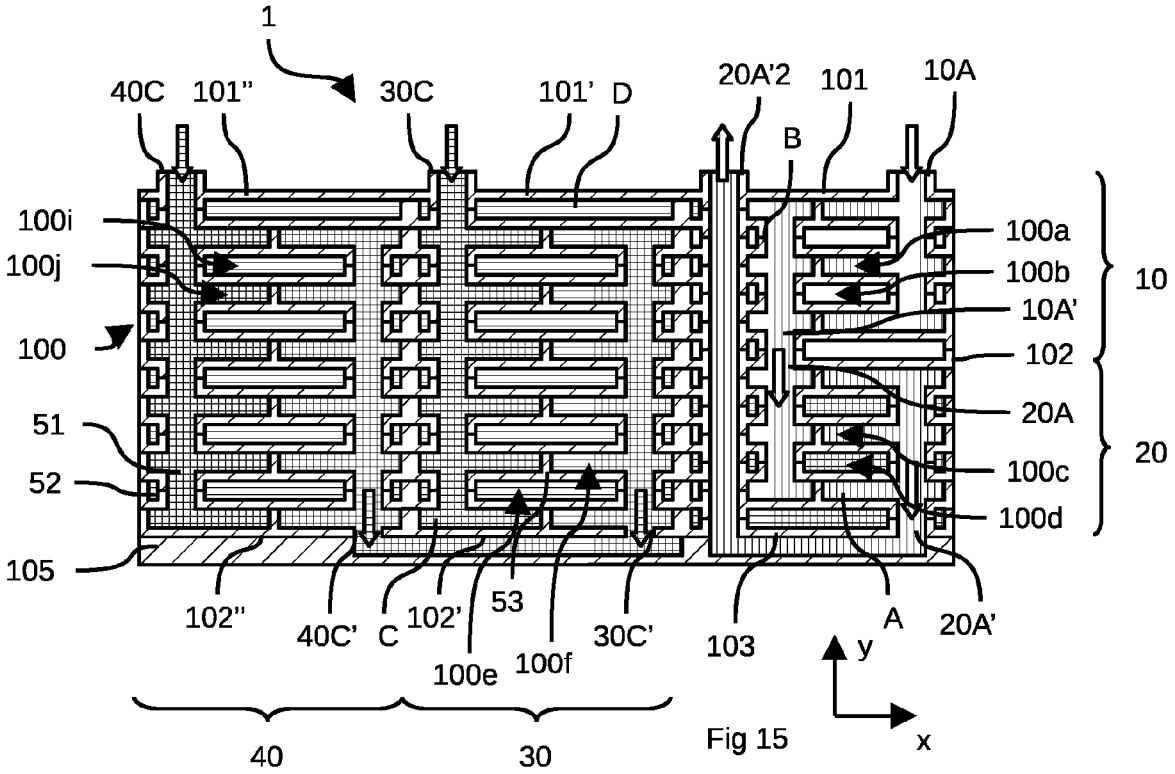
Figure 16:
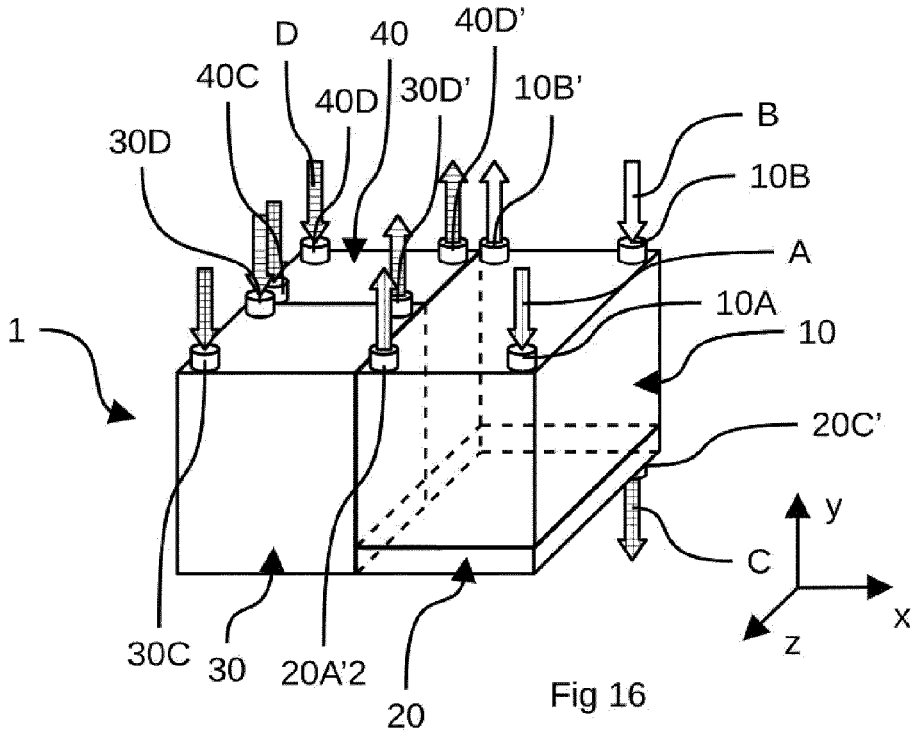

Other features and advantages of the invention will become more clearly apparent on reading the following description, given by way of illustrative and nonlimiting example, and from the accompanying drawings, in which:

FIG. 1 shows a schematic perspective representation of a heat exchanger according to a first embodiment, FIG. 2 shows a schematic exploded perspective representation of the heat exchanger of FIG. 1, FIG. 3 shows a schematic representation in a first section of the heat exchanger of FIG. 1 according to a first variant, FIG. 4 shows a schematic representation in a second section of the heat exchanger of FIG. 1 according to the first variant, FIG. 5 shows a schematic representation in a first section of the heat exchanger of FIG. 1 according to a second variant, FIG. 6 shows a schematic representation in a second section of the heat exchanger of FIG. 1 according to the second variant, FIG. 7 shows a schematic representation of a thermal management device, FIG. 8 shows a schematic representation in a first section of the heat exchanger of FIG. 1 according to a third variant, FIG. 9 shows a schematic representation in a second section of the heat exchanger of FIG. 1 according to the third variant, FIG. 10 shows a schematic perspective representation of a heat exchanger according to a second embodiment, FIG. 11 shows a schematic representation in a first section of the heat exchanger of FIG. 10, FIG. 12 shows a schematic representation in a second section of the heat exchanger of FIG. 10, FIG. 13 shows a schematic perspective representation of a heat exchanger according to a third embodiment, FIG. 14 shows a schematic representation in a first section of the heat exchanger of FIG. 13, FIG. 15 shows a schematic representation in a second section of the heat exchanger of FIG. 13, FIG. 16 shows a schematic perspective representation of a heat exchanger according to a fourth embodiment.

In the various figures, identical elements bear the same reference signs.

The following embodiments are examples. Although the description refers to one or more embodiments, this does not necessarily mean that each reference relates to the same embodiment, or that the features apply only to one embodiment. Individual features of different embodiments can also be combined or interchanged to provide other embodiments.

In the present description, some elements or parameters may be indexed, such as, for example, a first element or a second element and a first parameter and a second parameter or even a first criterion and a second criterion, etc. In this case, this is simply indexing for differentiating and naming elements or parameters or criteria that are similar but not identical. This indexing does not imply a priority of one element, parameter or criterion with respect to another and it is readily possible to interchange such names without departing from the scope of the present description. Nor does this indexing imply an order in time, for example, for assessing such or such criteria.

FIGS. 1 to 4 show a heat exchanger 1 comprising three heat-exchange compartments 10, 20 and 30. The heat exchanger 1 is formed in particular by a stack of plates 100, generally stamped metal plates delimiting various circulation paths 100*a*, 100*b*, 100*c*, 100*d*, 100*e*, 100*f* of heat-transfer fluids, for example by means of ribs 53. The plates 100 may in particular comprise open orifices 51 allowing the inlet and outlet of the heat-transfer fluid circulating in the circulation path 100*a*, 100*b*, 100*c*, 100*d*, 100*e*, 100*f* and closed orifices 52 allowing a heat-transfer fluid to pass through the plate simply without it circulating in the circulation path 100*a*, 100*b*, 100*c*, 100*d*, 100*e*, 100*f*. The plates 100 may in particular be made of a metallic material such as aluminum or an aluminum alloy and brazed together.

The first heat-exchange compartment 10 comprises a first circulation path 100*a* in which a first heat-transfer fluid A is intended to circulate between an inlet 10A and an outlet 10A' for said first heat-transfer fluid 1. The second circulation path 100*b* is intended to ensure the circulation of a second heat-transfer fluid B between an inlet 10B and an outlet 10B' for said second heat-transfer fluid B. The first 100*a* and second 100*b* circulation paths are stacked alternately. Preferably, the directions of circulation in the first 100*a* and second 100*b* circulation paths are counter-current in order to improve heat exchanges between the two fluids.

The second heat-exchange compartment 20 comprises a third circulation path 100*c* in which the first heat-transfer fluid A is intended to circulate between an inlet 20A and an outlet 20A' for said first heat-transfer fluid A. The first 10 and second 20 compartments are stacked so that the outlet 10A' for the first heat-transfer fluid A from the first compartment 10 is opposite and connected to the inlet 20A for the first heat-transfer fluid A into the second compartment 20. The second compartment 20 also comprises a fourth circulation path 100*d* in which a third heat-transfer fluid C is intended to circulate between an inlet 20C and an outlet 20C' for said third heat-transfer fluid C. The third 100*c* and fourth 100*d* circulation paths are stacked alternately. Preferably, the directions of circulation in the third 100*c* and the fourth 100*d* circulation paths are counter-current in order to improve the heat exchanges between the two fluids.

The third heat-exchange compartment 30 comprises a fifth circulation path 100*e* in which a fourth heat-transfer fluid D is intended to circulate between an inlet 30D and an outlet 30D' for the fourth heat-transfer fluid D. The third compartment 30 also comprises a sixth circulation path 100*f* in which the third heat-transfer fluid C is intended to circulate between an inlet 30C and an outlet 30C' for said third heat-transfer fluid C. The outlet 30C' for the third heat-transfer fluid C from the third compartment 30 is more particularly connected to the inlet 20C for the third heat-transfer fluid C into the second compartment 20. The fifth 100*e* and sixth 100*f* circulation paths are stacked alternately. Preferably, the directions of circulation in the fifth 100*e* and the sixth 100*f* circulation paths are counter-current in order to improve the heat exchanges between the two fluids.

The third compartment 30 is arranged side by side with the first compartment 10. This makes it possible, in combination with the fact that the first 10 and second 20 compartments are stacked, to have a compact heat exchanger 1 grouping together three functions of heat exchange between the first A and the second B heat-transfer fluid in the first compartment 10, between the first A and the third C heat-transfer fluid in the second compartment 20 and between the third C and fourth D heat-transfer fluid in the third compartment 30.

According to a first embodiment illustrated in FIGS. 1 to 4, the first 10 and the third 30 heat-exchange compartments are arranged side by side and stacked on the same face of the second heat-exchange compartment 20. The outlet 30C' for the third heat-transfer fluid C from the third heat-exchange compartment 30 is then opposite and connected to the inlet 20C for the third heat-transfer fluid C into the second heat-exchange compartment 20.

The first compartment 10 thus comprises a first end plate or cheek 101 arranged at a first end of the stack of plates 100 and comprising the inlet 10A for the first heat-transfer fluid A as well as the inlet 10B and the outlet 10B' for the second heat-transfer fluid B. At a second end of the stack of plates 100, the first compartment 10 comprises a second end plate 102 forming an interface with the second compartment 20. This second end plate 102 in particular allows the first heat-transfer fluid A to pass into the second compartment 20 but blocks the second heat-transfer fluid B so that it circulates only within the first compartment 10.

The third compartment 30 for its part comprises a first end plate or cheek 101' arranged at a first end of the stack of plates 100 and comprising the inlet 30C for the third heat-transfer fluid C as well as the inlet 30D and the outlet 30D' for the fourth heat-transfer fluid D. At a second end of the stack of plates 100, the third compartment 30 also comprises a second end plate 102' forming an interface with the second compartment 20. This second end plate 102*e* in particular allows the third heat-transfer fluid A to pass into the second compartment 20 but blocks the fourth heat-transfer fluid D so that it circulates only within the third compartment 30.

The second compartment 20 for its part comprises an end plate 103 arranged at the end of its stack of plates 100 opposite to the end opposite the first 10 and third 30 compartments. This end plate 103 comprises in particular the outlet 20A' for the first heat-transfer fluid A and the outlet 20C' for the third heat-transfer fluid C.

In the example illustrated in FIGS. 1 to 4, the second compartment 20 covers an area at least equal to the addition of the area of the first 10 and second 20 compartments so that said first 10 and second 20 compartments can rest entirely on the second compartment 20. The circulation paths 100*a*, 100*b*, 100*e* and 100*f* of the first 10 and second 20 each comprise two passes per plate 100. The circulation paths 100*c*, 100*d* of the second compartment 20 for their part comprise four passes per plate 100.

Still according to the example illustrated in FIGS. 1 to 4, the first 10 and third 30 compartments comprise the same number of plates 100 so that the height of the first 10 and third 30 compartments is identical. However, it is entirely possible to imagine an alternative in which the first 10 and third 30 compartments comprise a separate number of plates 100 in order to meet constraints and demands for heat exchange power of said compartments.

According to a first variant of the first embodiment visible in FIGS. 3 and 4 in section, the first 10 and third 30 compartments are made from two separate stacks of plates.

According to a second variant of the first embodiment visible in FIGS. 5 and 6 in section, the side-by-side parts of the first 10 and third 30 compartments are made from a single stack of plates 100 comprising the first 100*a*, second 100*b*, fifth 100*e* and sixth 100*f* circulation paths.

The heat exchanger 1 may in particular be connected within a thermal management device G illustrated in FIG. 7. This thermal management device G comprises a thermal management loop X within which a refrigerant fluid is intended to circulate. This thermal management loop X comprises, in the direction of circulation of the refrigerant fluid, a compressor 3, a condenser 10, an expansion device 4 and a cooler 30. The thermal management loop X also comprises an internal heat exchanger 20 connected, on the one hand, to the high-pressure refrigerant fluid (shown in thick lines) coming from the condenser 10 and, on the other hand, to the low-pressure refrigerant fluid (shown in thin lines) coming from the cooler 30. The thermal management loop X may also comprise a phase separation device 5, for example an accumulator arranged upstream of the compressor 3. This phase separation device 5 may be arranged between the internal heat exchanger 20 and the compressor 3, as illustrated in FIG. 7. In an alternative (not shown), the phase separation device 5 may be arranged between the cooler 30 and the internal heat exchanger 20. The refrigerant fluid may, for example, be R744 or R1234yf.

The condenser 10 is also connected to a first auxiliary thermal management loop Y in which a heat-transfer fluid, for example glycol water, is intended to circulate. In addition to the condenser 10, this first auxiliary thermal management loop Y may comprise a pump 6 and a radiator 7, for example intended to be traversed by an external air flow in order to dissipate heat.

The cooler 30 for its part is connected to a second auxiliary thermal management loop Z in which a heat-transfer fluid, for example glycol water, is intended to circulate. In addition to the cooler 30, this second auxiliary thermal management loop Z may comprise a pump 8 and a heat exchanger 9, for example intended to cool an element of the motor vehicle such as, for example, the batteries.

The first heat-exchange compartment 10 may in particular correspond to the condenser 10. The first circulation path 100*a* is then intended to be traversed by the first heat-transfer fluid A, being the high-pressure refrigerant fluid. The second circulation path 100*b* for its part is intended to be traversed by the second heat-transfer fluid B, being the heat-transfer fluid circulating in the first auxiliary thermal management loop Y.

The third heat-exchange compartment 30 may correspond to the cooler 30. The fifth circulation path 100*e* is then intended to be traversed by the fourth heat-transfer fluid D, being the heat-transfer fluid circulating in the second auxiliary thermal management loop Z. The sixth circulation path 100*f* for its part is intended to be traversed by the third heat-transfer fluid C, being the low-pressure refrigerant fluid.

The second heat-exchange compartment 20 may finally correspond to the internal heat exchanger 20. The third circulation path 100*c* is then intended to be traversed by the high-pressure refrigerant fluid A having traversed the first compartment 10. The fourth circulation path 100*d* for its part is intended to be traversed by the low-pressure refrigerant fluid C having traversed the third heat-exchange compartment 30.

The thermal management device X illustrated in FIG. 7 is only one example; it is quite possible to imagine different architectures, in particular, for example, in which the first Y and second Z auxiliary thermal management loops are grouped together within the same auxiliary thermal management loop. The second B and the fourth C heat-transfer fluid would then be the same heat-transfer fluid circulating in this auxiliary thermal management loop.

According to an alternative to the first embodiment illustrated in FIGS. 8 and 9, the second compartment 20 may comprise a second inlet 20A2 for the first refrigerant fluid A. This second inlet 20A2 may in particular join the first heat-transfer fluid A coming from the inlet 20A in order to circulate in the third circulation paths 100*c*. This second inlet 20A2 may, for example, make it possible to connect to the second compartment 20, acting as an internal heat exchanger, a second condenser (not shown), for example connected in parallel with the first compartment 10 within the thermal management loop X.

Still according to the alternative to the first embodiment illustrated in FIGS. 8 and 9, the second compartment 20 may comprise a second inlet 20C2 for the third refrigerant fluid C. This second inlet 20C2 may in particular join the third heat-transfer fluid C coming from the inlet 20C in order to circulate in the fourth circulation paths 100*b*. This second inlet 20C2 may, for example, make it possible to connect to the second compartment 20. acting as an internal heat exchanger, a second cooler (not shown), for example connected in parallel with the third compartment 30 within the thermal management loop X.

According to a second embodiment illustrated in FIGS. 10 to 12, the third compartment 30 is arranged side by side with the superposition of the first 10 and second 20 compartments. According to this second embodiment, only the first compartment 10 is arranged on the second compartment 20.

In this second embodiment, the second end plate 102' of the third compartment 30 is thus not side by side with the second end plate 102 of the first compartment 10 as in the first embodiment, but side by side with the second end plate 103 of the second compartment 20. The outlet 30C' for the third heat-transfer fluid C from the third compartment 30 is thus connected to the inlet 20C for the third heat-transfer fluid C into the second compartment 20. In the example illustrated in FIGS. 11 and 12, this connection is made by a connecting plate 105 delimiting these ducts connecting the outlet 30C' and the inlet 20C and arranged opposite the end plate 103 of the second compartment 20 and the second end plate 102' of the third compartment 30. Still according to the example illustrated, the heat exchanger 1 may also comprise a channel 20A'2 passing through the first 10 and second 20 compartments so as to extend the outlet 20A' for the first heat-transfer fluid A from the second compartment 20 so that the first heat-transfer fluid A emerges through the first end plate 101 of the first compartment 10. The outlet 20A' of the second compartment 20 is connected here to the inlet of this channel 20A'2 by a duct formed in the connecting plate 105.

According to this second embodiment and like the first embodiment, the first 10 and third 30 compartments may be made from two separate stacks of plates 100. According to a variant, the side-by-side parts of the first 10 and third 30 compartments may be made from a single stack of plates 100 comprising the first 100*a*, second 100*b*, fifth 100*e* and sixth 100*f* circulation paths.

Similarly, the second 20 and third 30 compartments may be made from two separate stacks of plates. According to another variant, the side-by-side parts of the second 20 and third 30 compartments may be made from a single stack of plates 100 comprising the third 100*c*, fourth 100*d*, fifth 100*e* and sixth 100*f* circulation paths.

According to the example illustrated in FIGS. 10 to 12, the third 30 compartment comprises the same number of plates 100 as the first 10 and second 20 compartments joined together so that the height of the third compartment is identical to the height of the superposition of the first 10 and second 20 compartments. However, it is entirely possible to imagine an alternative in which the third 30 compartment comprises a number of plates 100 distinct from the superposition of the first 10 and second 20 compartments in order to meet constraints and demands for heat exchange power of said compartments.

According to a third embodiment illustrated in FIGS. 13 to 16, the heat exchanger 1 may also comprise a fourth heat-exchange compartment 40. This fourth compartment 40 comprises in particular:

- a seventh circulation path 100*i* in which the fourth heat-transfer fluid D is intended to circulate between an inlet 40D and an outlet 40D' for the fourth heat-transfer fluid, and
- an eighth circulation path 100*j* in which the third heat-transfer fluid C is intended to circulate between an inlet 40C and an outlet 40C' for the third heat-transfer fluid C.

According to a first alternative of the third embodiment illustrated in FIGS. 13 to 16, the outlet 40C' for the third heat-transfer fluid C from the fourth compartment 30 can be connected to the inlet 20C for the third heat-transfer fluid C into the second compartment 20. The seventh 100*i* and eighth 100*j* circulation paths are stacked alternately. Preferably, the directions of circulation in the seventh 100*i* and the eighth 100*j* circulation paths are counter-current in order to improve the heat exchanges between the two fluids. More particularly, the outlet 40C' of the fourth compartment 40 and the outlet 30C' of the third compartment 30 are both connected to the inlet 20C for the third heat-transfer fluid C into the second compartment 20.

According to a second alternative of the third embodiment (not shown), the outlet 40C' for the third heat-transfer fluid C from the fourth compartment 30 may be free or directly connected to the outlet 20C' for the third heat-transfer fluid C from the second compartment 20.

FIGS. 13 to 15 show a first variant of this third embodiment in which the third compartment 30 is arranged side by side with the first compartment 10 on a first side and the fourth compartment 40 is arranged side by side with the third compartment 30 on a second side of the third compartment 30 opposite its first side.

The example of FIGS. 13 to 15 repeats the feature of the second embodiment in which the third compartment 30 is arranged side by side with the superposition of the first 10 and second 20 compartments. Thus, in this example, only the first compartment 10 is arranged on the second compartment 20. However, it is quite possible to imagine an embodiment in which the first 10, the third 30 and the fourth 40 compartments are arranged on the second compartment 20.

Returning to the example of FIGS. 13 to 15, the outlet 40C' of the fourth compartment 40 and the outlet 30C' of the third compartment 30 are both connected to the inlet 20C for the third heat-transfer fluid C into the second compartment 20 via the connecting plate 105.

FIG. 16 shows a second variant of the third embodiment in which the third compartment 30 and the fourth compartment 40 are both arranged side by side with the first compartment 10 on a first side. The fourth compartment 40 is also arranged side by side with the third compartment 30 on a second side of the third compartment 30 contiguous with its first side. As for the first variant, the example illustrated in FIG. 16 repeats the feature of the second embodiment in which the third compartment 30 is arranged side by side with the superposition of the first 10 and second 20 compartments. Thus, in this example, only the first compartment 10 is arranged on the second compartment 20. However, it is quite possible to imagine an embodiment in which the first 10, the third 30 and the fourth 40 compartments are arranged on the second compartment 20.

Thus, it can be seen clearly that the heat exchanger 1, by virtue of its division into different compartments 10, 20, 30 as well as the different connections of the circulation paths of the heat-transfer fluid, makes it possible to have a heat exchanger which is compact and which can group together various functions such as a condenser, a cooler and an internal heat exchanger. This allows better compactness for better integration within a motor vehicle. In addition, the structure of the heat exchanger 1 also makes it easier to assemble in particular at the connections with a thermal management device comprising various circulation circuits because it already incorporates certain connections within it and thus reduces the number of connections necessary.

The invention claimed is:

1. A plate heat exchanger comprising:

a first heat-exchange compartment comprising a first circulation path in which a first heat-transfer fluid circulates, and a second circulation path in which a second heat-transfer fluid circulates, wherein the first heat-exchange compartment comprises an outlet for the first heat-transfer fluid, a second heat-exchange compartment comprising a third circulation path in which the first heat-transfer fluid coming from the first heat-exchange compartment circulates, and a fourth circulation path in which a third heat-transfer fluid circulates, wherein the second heat-exchange compartment comprises an inlet for the first heat-transfer fluid, and a third heat-exchange compartment comprising a fifth circulation path in which a fourth heat-transfer fluid circulates, and a sixth circulation path in which the third heat-transfer fluid circulates, wherein the third heat-exchange compartment comprises an outlet for the third heat-transfer fluid, wherein the outlet for the first heat-transfer fluid from the first heat-exchange compartment is connected to the inlet for the first heat-transfer fluid into the second heat-exchange compartment, wherein the outlet for the third heat-transfer fluid from the third heat-exchange compartment is connected to the inlet for the third heat-transfer fluid into the second heat-exchange compartment, wherein the first heat-exchange compartment is stacked on top of the second heat-exchange compartment such that the outlet for the first heat-transfer fluid from the first heat-exchange compartment is arranged opposite, above, and connected to the inlet for the first heat-transfer fluid into the second heat-exchange compartment, and wherein the third heat-exchange compartment is arranged side by side with the first heat-exchange compartment, wherein the first and third heat-exchange compartments are stacked on a same face of the second heat-exchange compartment, wherein the second heat-exchange compartment comprises a third end plate opposite a corresponding end of each of the first and third heat-exchange compartments, wherein the third end plate comprises an outlet for the first heat-transfer fluid and an outlet for the third heat-transfer fluid.

2. The heat exchanger as claimed in claim 1, wherein the outlet for the third heat-transfer fluid from the third heat-exchange compartment is opposite and connected to the inlet for the third heat-transfer fluid into the second heat-exchange compartment.

3. The heat exchanger as claimed in claim 1, wherein the first and third heat-exchange compartments are made from two separate stacks of plates.

4. The heat exchanger as claimed in claim 1, wherein the side-by-side parts of the first and third heat-exchange compartments are made from a single stack of plates, wherein the single stack of plates comprises the first, second, fifth and sixth circulation paths.

5. The heat exchanger as claimed in claim 1, wherein the first heat-exchange compartment is a water condenser, wherein the first circulation path is traversed by the first heat-transfer fluid, wherein the first heat-transfer fluid is a high-pressure refrigerant fluid circulating in a thermal management loop, wherein the second circulation path is traversed by the second heat-transfer fluid, wherein the second heat-transfer fluid is a heat-transfer fluid circulating in an auxiliary thermal management loop, wherein the third heat-exchange compartment is a cooler, wherein the fifth circulation path is traversed by the fourth heat-transfer fluid, wherein the fourth heat-transfer fluid is a heat-transfer fluid circulating in an auxiliary thermal management loop, wherein the sixth circulation path is traversed by the third heat-transfer fluid, wherein the third heat-transfer fluid is the low-pressure refrigerant fluid circulating in the thermal management loop, and wherein the second heat-exchange compartment is an internal heat exchanger configured to allow exchanges of heat energy between the high-pressure refrigerant fluid and the low-pressure refrigerant fluid, wherein the third circulation path is traversed by the high-pressure refrigerant fluid, wherein the high-pressure refrigerant fluid has traversed the first heat-exchange compartment, corresponding to the first heat-transfer fluid, wherein the fourth circulation path is traversed by the low-pressure refrigerant fluid, wherein the low-pressure refrigerant fluid has traversed the third heat-exchange compartment, corresponding to the third heat-transfer fluid.

6. The heat exchanger as claimed in claim 1, wherein the first compartment comprises a first end plate comprising the inlet for the first heat-transfer fluid, an inlet for the second heat-transfer fluid, and an outlet for the second heat-transfer fluid.

7. The heat exchanger as claimed in claim 6, wherein the first heat-exchange compartment comprises a second end plate forming an interface with the second heat-exchange compartment.

8. The heat exchanger as claimed in claim 7, wherein the second end plate is formed to allow the first heat-transfer fluid to pass into the second heat-exchange compartment and block the second heat-transfer fluid such that the second heat-transfer fluid only circulates within the first heat-exchange compartment.

9. The heat exchanger as claimed in claim 1, wherein the third heat-exchange compartment comprises:

a first end plate comprising the inlet for the third heat-transfer fluid, an inlet for the fourth heat-transfer fluid, and an outlet for the fourth heat-transfer fluid; and a second end plate forming an interface with the second heat-exchange compartment.

10. The heat exchanger as claimed in claim 9, wherein the second end plate is formed to allow the third heat-transfer fluid to pass into the second heat-exchange compartment and block the fourth heat-transfer fluid such that the fourth heat-transfer fluid only circulates within the third compartment.

* * * * *